US010305234B2

(12) United States Patent
Holliday et al.

(10) Patent No.: US 10,305,234 B2
(45) Date of Patent: May 28, 2019

(54) MINI COAX CABLE CONNECTOR

(71) Applicant: PPC Broadband, Inc., East Syracuse, NY (US)

(72) Inventors: Randall A. Holliday, Broomfield, CO (US); Jimmy Yao, Taipei (TW)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 15/694,313

(22) Filed: Sep. 1, 2017

(65) Prior Publication Data

US 2017/0365960 A1 Dec. 21, 2017

Related U.S. Application Data

(63) Continuation of application No. 15/060,882, filed on Mar. 4, 2016, now Pat. No. 9,755,378, which is a continuation of application No. 14/027,877, filed on Sep. 16, 2013, now Pat. No. 9,281,637, which is a continuation-in-part of application No. 13/400,282, filed on Feb. 20, 2012, now Pat. No. 8,535,092, which (Continued)

(51) Int. Cl.

| | |
|---|---|
| ***H01R 24/40*** | (2011.01) |
| ***H01R 24/38*** | (2011.01) |
| ***H01R 9/05*** | (2006.01) |
| *H01R 103/00* | (2006.01) |
| *H01R 24/44* | (2011.01) |

(52) U.S. Cl.

CPC ..... *H01R 24/40* (2013.01); *H01R 9/0518* (2013.01); *H01R 24/38* (2013.01); *H01R 24/44* (2013.01); *H01R 2103/00* (2013.01)

(58) Field of Classification Search

CPC ..... H01R 2103/00; H01R 13/2414; H01R 24/40; H01R 13/521; H01R 13/533; H01R 13/6277; H01R 24/50; H01R 12/52; H01R 12/62; H01R 12/7082; H01R 12/714; H01R 12/721; H01R 12/727; H01R 12/73

See application file for complete search history.

(56) References Cited

U.S. PATENT DOCUMENTS 2,369,180 A 2/1945 Rosenthal
3,126,750 A 3/1964 Willis (Continued)

OTHER PUBLICATIONS

Columbia Patent and Trademark Office (Superintendencia de Industria y Comercio), Office Action in Columbian Patent Application No. 16093875, received Sep. 6, 2017 (9 pages) with English language translation of same.

(Continued)

*Primary Examiner* — Truc T Nguyen
(74) *Attorney, Agent, or Firm* — Oliff PLC

(57) ABSTRACT

A cable connector comprising a connector body, a compression member operably connected to a second end of the connector body, the compression member including a compression portion having a forward facing surface, wherein the compression portion protrudes from an inner surface of the compression member, wherein, when the compression member is slidably axially compressed within the connector body, the compression portion of the compression member compresses an inner sleeve into crimping engagement with a coaxial cable is provided. An associated method is also provided.

26 Claims, 12 Drawing Sheets

Related U.S. Application Data is a continuation of application No. 12/685,606, filed on Jan. 11, 2010, now Pat. No. 8,142,223, which is a continuation-in-part of application No. 11/895,367, filed on Aug. 24, 2007, now Pat. No. 7,645,161, which is a continuation-in-part of application No. 11/716,488, filed on Mar. 9, 2007, now Pat. No. 8,464,422, which is a continuation-in-part of application No. 10/927,884, filed on Aug. 27, 2004, now Pat. No. 7,188,507.

(56) References Cited

U.S. PATENT DOCUMENTS 3,296,363 A 1/1967 Laudig et al.
3,854,789 A * 12/1974 Kaplan ..... H01R 9/0521 439/584
4,456,323 A * 6/1984 Pitcher ..... H01R 9/0521 439/584
4,668,043 A 5/1987 Saba et al.
4,684,201 A 8/1987 Hutter
4,685,201 A 8/1987 Boyd, Jr.
4,902,246 A 2/1990 Samchisen
4,923,412 A * 5/1990 Morris ..... H01R 9/0521 439/578
4,932,091 A 6/1990 Krzyzanski
5,024,606 A 6/1991 Ming-Hwa
5,073,129 A 12/1991 Szegda
5,105,648 A 4/1992 Steiner et al.
5,127,853 A 7/1992 McMills et al.
5,269,701 A 12/1993 Leibfried, Jr.
5,392,508 A 2/1995 Holliday et al.
5,469,613 A 11/1995 McMills et al.
5,470,257 A 11/1995 Szegda
5,479,613 A 12/1995 Geyer et al.
5,501,616 A 3/1996 Holliday
5,529,513 A 6/1996 Lee
5,546,653 A 8/1996 Tournier et al.
5,586,910 A 12/1996 Del Negro et al.
5,595,499 A 1/1997 Zander et al.
5,651,698 A 7/1997 Locati et al.
5,651,699 A 7/1997 Holliday
5,667,405 A 9/1997 Holliday
5,845,393 A 12/1998 Depaiva
5,863,220 A 1/1999 Holliday
5,934,137 A 8/1999 Tarpill
5,975,949 A 11/1999 Holliday et al.
5,997,350 A 12/1999 Burris et al.
6,089,913 A 7/2000 Holliday
6,112,404 A 9/2000 Tarpill
6,146,197 A 11/2000 Holliday
6,153,830 A 11/2000 Montena
6,293,004 B1 9/2001 Holliday
6,305,978 B1 10/2001 Ko et al.
6,352,448 B1 3/2002 Holliday
6,594,888 B2 7/2003 Chang
6,708,396 B2 3/2004 Holliday
6,783,394 B1 8/2004 Holliday
6,805,583 B2 10/2004 Holliday et al.
6,830,479 B2 12/2004 Holliday
6,848,940 B2 2/2005 Montena
6,916,200 B2 7/2005 Burris et al.
6,929,508 B1 8/2005 Holland ..... H01R 9/0518 439/579
6,935,892 B2 * 8/2005 Holliday ..... H01R 9/0524 439/578
6,948,234 B1 9/2005 Steiner
7,025,246 B2 4/2006 Wild
7,029,326 B2 4/2006 Montena
7,044,771 B2 5/2006 Holliday
7,070,447 B1 7/2006 Montena
7,108,547 B2 9/2006 Kisling
7,131,868 B2 * 11/2006 Montena ..... H01R 9/0518 439/578
7,156,695 B2 1/2007 Holliday
7,156,696 B1 1/2007 Montena
7,179,122 B2 2/2007 Holliday
7,182,628 B2 2/2007 Holliday
7,188,507 B2 3/2007 Holliday et al.
7,326,079 B2 2/2008 Holliday et al.
7,367,832 B2 5/2008 Muhs et al.
7,410,389 B2 8/2008 Holliday
7,507,116 B2 3/2009 Laerke et al.
7,645,161 B2 1/2010 Holliday
7,727,015 B2 6/2010 Holliday
8,075,339 B2 12/2011 Holliday
8,142,223 B2 3/2012 Holliday
8,464,422 B2 6/2013 Holliday et al.
2003/0224657 A1 * 12/2003 Malloy ..... H01R 9/0521 439/578
2004/0110418 A1 * 6/2004 Holliday ..... H01R 9/0524 439/585
2005/0026497 A1 * 2/2005 Holliday ..... H01R 9/0524 439/578
2005/0148236 A1 7/2005 Montena
2005/0164552 A1 * 7/2005 Wlos ..... H01R 13/6277 439/578
2005/0277330 A1 * 12/2005 Kisling ..... H01R 9/0524 439/578
2006/0042346 A1 3/2006 Holliday et al.
2006/0105628 A1 5/2006 Montena ..... H01R 9/0524 439/578
2006/0240709 A1 10/2006 Montena et al.
2008/0096419 A1 4/2008 Purdy ..... H01R 9/0527 439/578
2010/0144200 A1 6/2010 Holliday
2010/0151728 A1 6/2010 Chabalowski ..... H01R 9/0521 439/584
2010/0255720 A1 10/2010 Radzik ..... H01R 24/40 439/578
2012/0270442 A1 10/2012 Holliday
2013/0178096 A1 7/2013 Matzen

OTHER PUBLICATIONS

Mexican Patent Office "IMPI" (Instituto Mexicano de la Propiedad Industrial), Office Action in Mexican Patent Application No. MX/a/2016/003303, dated Aug. 24, 2017 (4 pages) with English language translation of same.
Danish Patent and Trademark Office, Office Action with Search Report and Search Opinion in Danish Patent Application No. PA 2016 70206 (total 6 pages) dated Nov. 9, 2017.
Office Action (dated Nov. 30, 2012) for U.S. Appl. No. 13/400,282, filed Feb. 20, 2012.
Notice of Allowance (dated Mar. 21, 2013) for U.S. Appl. No. 13/400,282, filed Feb. 20, 2012.
U.S. Patent and Trademark Office (ISA/US), International Search Report and Written Opinion from PCT/US14/55398 as completed Dec. 1, 2014 (total 13 pgs.).

* cited by examiner

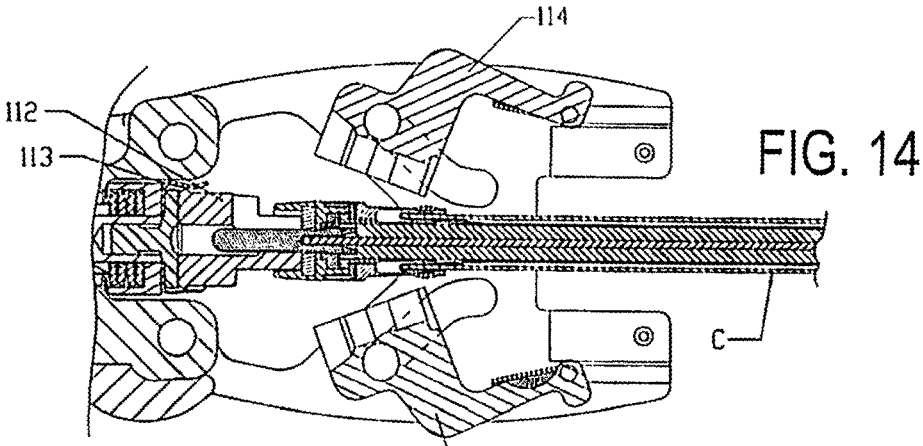
FIG. 14
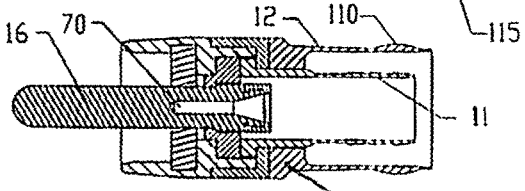
FIG. 15 10'
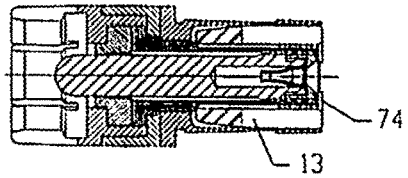
FIG. 16

MINI COAX CABLE CONNECTOR

CROSS-REFERENCE TO RELATED APPLICATIONS

This application is a continuation of U.S. application Ser. No. 15/060,882, filed Mar. 4, 2016 and entitled "MINI COAX CABLE CONNECTOR" which is a continuation of U.S. application Ser. No. 14/027,877, filed Sep. 16, 2013 now U.S. Pat. No. 9,281,637 issued Mar. 8, 2016, and entitled "MINI COAX CABLE CONNECTOR", which is a continuation-in-part of U.S. application Ser. No. 13/400,282, filed Feb. 20, 2012 now U.S. Pat. No. 8,535,092 issued Sep. 17, 2013, and entitled "Mini Coax Cable Connector," which is a continuation of U.S. application Ser. No. 12/685,606, filed Jan. 11, 2010, now U.S. Pat. No. 8,142,223 issued Mar. 27, 2012, which is a continuation-in-part of U.S. application Ser. No. 11/895,367, filed Aug. 24, 2007, now U.S. Pat. No. 7,645,161 issued Jan. 12, 2010, which is a continuation-in-part of U.S. application Ser. No. 11/716,488, filed Mar. 9, 2007, now U.S. Pat. No. 8,464,422 issued Jun. 18, 2013, which is a continuation-in-part of U.S. application Ser. No. 10/927,884, filed Aug. 27, 2004, now U.S. Pat. No. 7,188,507 issued Mar. 13, 2007. All of these applications are incorporated by reference herein in their entireties.

BACKGROUND

The following relates to coaxial cable connectors and more particularly relates to a novel and improved mini-coaxial cable connector assembly which is conformable for use with different size cables in effecting positive engagement with a connector assembly in connecting the cable to a post or terminal.

The problems associated with the connection of mini-coaxial cables as well as larger size cables to a post or terminal in the field are discussed at some length in hereinabove referred to co-pending application for patent for MINI-COAXIAL CABLE CONNECTOR and in U.S. Pat. No. 6,352,448 for CABLE TV END CONNECTOR STARTER GUIDE. This invention is directed to further improvements in termination assemblies to be employed for mini coaxial cables in which the termination assembly is characterized in particular by being comprised of a minimum number of preassembled parts which can be quickly assembled at the manufacturing site as well as in the field and is readily conformable for connection of different sized mini-coaxial cables to BNC and RCA connectors. Further wherein an extension tip can be recessed to permit a conductor to be positioned toward the back of the connector assembly, such as, for example, RCA connector assemblies; and including a novel form of centering guide for guiding the conductor into the recessed end of the extension tip.

SUMMARY

In one aspect it is desirable to eliminate any form of a coupling or adaptor sleeve for small diameter coaxial cables so that the cable can be installed directly into the end of an extension tip which has been preassembled within the connector body.

In another aspect the connector body is provided with the necessary adaptability for connection to different sized cables and in such a way as to assure accurate alignment between the cable and connector preliminary to crimping of the connector onto the cable and prevents shorting between the cable layers with one another as well as with conductive portions of the connector; and specifically wherein inner and outer concentric compression members in the crimping region of the connector body cooperate in effecting positive engagement with the cable.

The foregoing is achieved by direct connection of the exposed end of a coaxial cable to an extension tip either prior to or after mounting of the extension tip in a hollow connector body wherein the cable is of the type having inner and outer concentric electrical conductors, an annular dielectric separating the conductors and an outer jacket of electrically non-conductive material, the inner and outer conductors being exposed at the end and the inner conductor projecting beyond the dielectric at one end of the cable; and the connector body is characterized by having a slotted compression ring which cooperates with an inner slotted sleeve to effect positive engagement with the cable in response to radially inward compression. The inner sleeve and compression ring are dimensioned to undergo the necessary compression in response to axial advancement of a crimping ring, and the trailing end of the inner sleeve is slotted to form prong-like segments having internal and external teeth so that the trailing end of the sleeve can be compressed into engagement with the cable without crushing the dielectric layer.

A spring-like retainer clip within a bore at one end of the extension tip is adapted to grasp the conductor pin and connect to the tip, and the retainer clip can be varied in size for different diameter conductor pins. Elimination of the adaptor sleeve on the cable affords greater latitude in visualization of the color of the extension tip as well as the compression ring; and either or both may be color-coded to match up with different sized cables.

A further aspect relates generally to cable connector comprising: a connector body, a compression member operably connected to a second end of the connector body, the compression member including a compression portion having a forward facing surface, wherein the compression portion protrudes from an inner surface of the compression member, wherein, when the compression member is slidably axially compressed within the connector body, the compression portion of the compression member compresses an inner sleeve into crimping engagement with a coaxial cable.

A further aspect relates generally to a coaxial cable connector having a hollow connector body, wherein the coaxial cable connector includes an elongated conductor pin, and wherein said coaxial cable connector includes an inner sleeve disposed within the connector body, comprising an extension tip inserted in a main bore of the connector body, the tip provided with a recess at one end for insertion of the conductor pin and an extension rod removably connected to an opposite end of the tip and wherein the tip and the rod are slidable through the connector body in response to axial movement of the cable and pin through the connector body; and a compression member operably connected to a second end of the connector body for compressing a slotted end of the inner sleeve into engagement with a coaxial cable.

A further aspect relates generally to a method comprising: providing a connector having a connector body, a compression member operably connected to a second end of the connector body, the compression member including a compression portion having a forward facing surface, wherein the compression portion protrudes from an inner surface of the compression member, and axially advancing the compression portion to radially compress a slotted end of an inner sleeve disposed within the connector body into crimping engagement with a coaxial cable.

It is therefore to be understood that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed and reasonable equivalents thereof.

BRIEF DESCRIPTION

The above and other objects, advantages and features of the present invention will become more readily appreciated and understood from a consideration of the following detailed description of preferred and modified forms of the present invention when taken together with the accompanying drawings in which:

FIG. 14 is a somewhat fragmentary, longitudinal sectional view of a compression tool utilized in combination with another embodiment of a connector assembly;

FIG. 15 is a sectional view in more detail of the connector assembly shown in FIG. 14;

FIG. 16 is a sectional view of the end of another form of connector assembly utilized with mini-coaxial cable connectors;

DETAILED DESCRIPTION OF ONE EMBODIMENT

Figure 1:
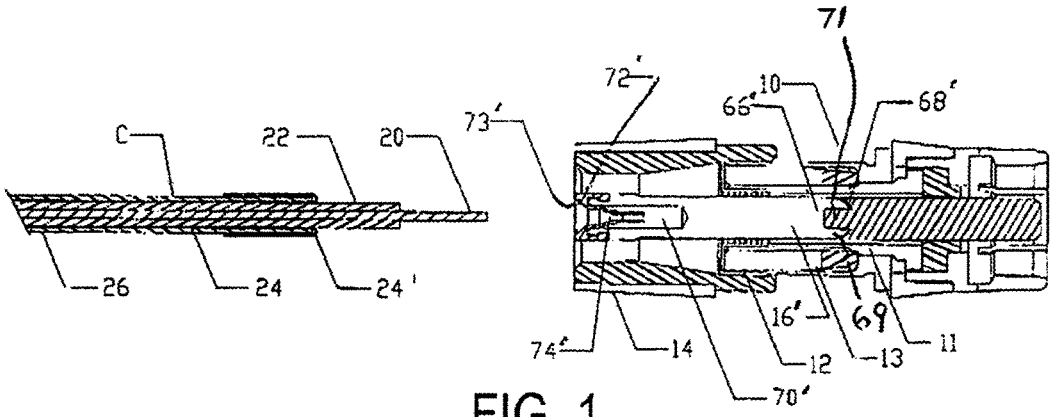
FIG. 1 is an exploded, longitudinal sectional view of one embodiment comprised of the standard mini-coaxial cable prior to insertion into a connector assembly having a modified pre-assembled extension tip.

Referring in more detail to the drawings, there is illustrated in FIGS. 1 to 8 one embodiment which is comprised of a standard mini-coaxial cable C, a hollow connector body 10 having inner and outer concentric sleeves 11 and 12, and a plastic compression ring 13. A crimping ring assembly 14 is preassembled at one end of the body 10, and a modified extension tip 16' is preassembled at the opposite end of the body 10 to the crimping ring assembly 14.

As a setting for the embodiments to be described, the cable C is made up of an inner conductor pin or wire 20 which is surrounded by a dielectric insulator 22 of electrically nonconductive material, such as, a rubber or rubber-like material, a braided conductor layer 24, and an outer jacket 26 of an electrically non-conductive material, such as, a rubber or rubber-like material. The end of the cable C is further prepared for assembly by removing a limited length of the jacket 26 and braided conductor 24 as well as the insulated layer 22 in order to expose an end of the pin 20 along with a foil layer surrounding the pin 20. The braided conductor layer 24 is peeled away from the insulator 22 and doubled over as at 24' to cover the leading end of the jacket 26.

As shown in FIGS. 1 to 8, the sleeve 11 has a thin-walled, annular trailing end 28 and sealing rings or ribs 29 along its inner surface in facing relation to the jacket 26, and the body 10 terminates in an annular shoulder 30 at one end having an annular end flange 32 in abutting relation to an insulator guide 33. The sleeve 11 is dimensioned such that the trailing end 28 will extend over the end of the doubled-over layer 24' when the pin 20 is inserted into the end of the extension tip 16 in a manner to be described in more detail. For this purpose, the layer 22 is exposed for a length corresponding to the length of the wall portion 28 of the sleeve 11 when assembled in the relationship shown in FIG. 4. The outer sleeve 12 has a thin-walled trailing end 34 aligned in outer spaced concentric relation to the end 28 to form an annular space therebetween for insertion of the compression ring 13, and the trailing end 34 is raised slightly from the outer surface of the sleeve 12 to form a shoulder 27 at one end to receive the offset end 15 of the crimping ring 14. The inner surface of the trailing end 34 is provided with a series of sealing ribs or rings 35 to engage the outer surface of the compression ring 13. The sleeve 12 terminates at its opposite end in a thickened annular end portion 40, including a radially inner wall surface flush with the external wall surface of the end flange 32, and a radially outwardly extending shoulder 39 is interposed between one end of the crimping ring assembly 14 and a reinforcing band 42 on the outside of the connector body 10.

Figure 8:
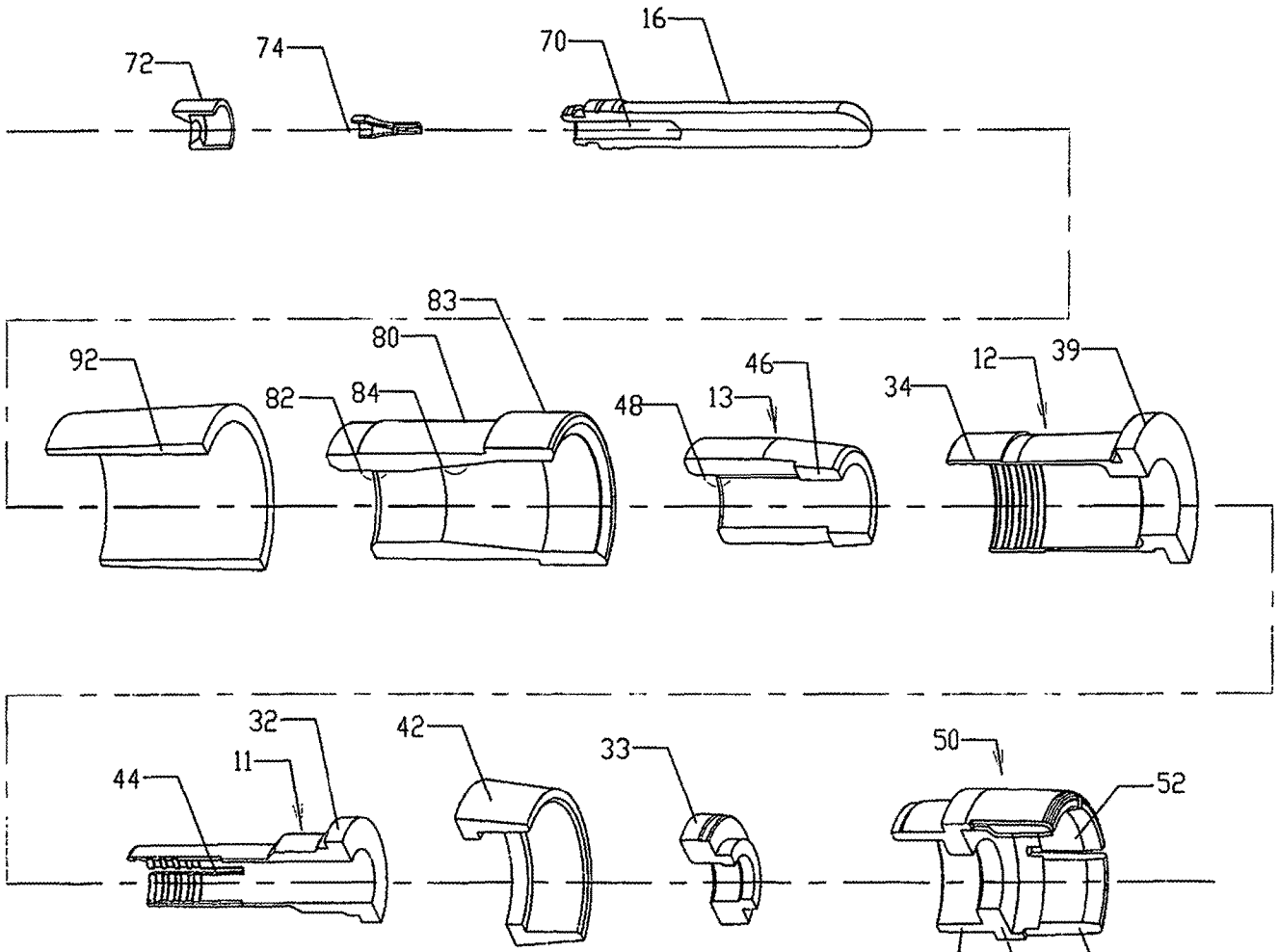
FIG. 8 is an exploded view of the parts comprising the modified extension tip and connector body prior to assembly.

As best seen from the exploded view of FIG. 8, the trailing end 28 of the inner sleeve 11 is provided with circumferentially spaced longitudinal slots 44 of a length substantially corresponding to the slotted end of the compression ring 13 to be described, the slots each being of a width to control the inward degree of bending by the crimping ring assembly 14. Similarly, the compression ring 13 has a solid or continuous annular end 46 and circumferentially spaced longitudinal slots 48 extending from the end 46 for the greater length of the ring 13 toward its trailing end and dividing the ring 13 into a series of elongated annular segments, the slots 48 each being of a width to control the degree of inward bending when compressed by the crimping assembly 14. Further, the compression ring 13 is composed of a plastic material of limited flexibility and dimensioned to be of a thickness to assure positive engagement of the inner sleeve 11 with the cable C when the extension tip 16' is inserted into the body 10. Again, it is important to dimension the width of the slots 48 to limit the amount of contraction of the ring 13 so that the sealing ribs 29 will compress the jacket 26 enough to prevent pull-out but not enough to crush the dielectric layer 22. This is especially important in cables operating at higher frequencies in which any bending or crushing of the dielectric can create an impedance that downgrades the signal and prevents return losses. As further seen from FIG. 3, the prepared cable C is inserted into the tip 16' and advanced through the body 10 until the slotted segments of the inner sleeve 11 are positioned over the doubled-over layer 24' and jacket 26.

Figure 3:
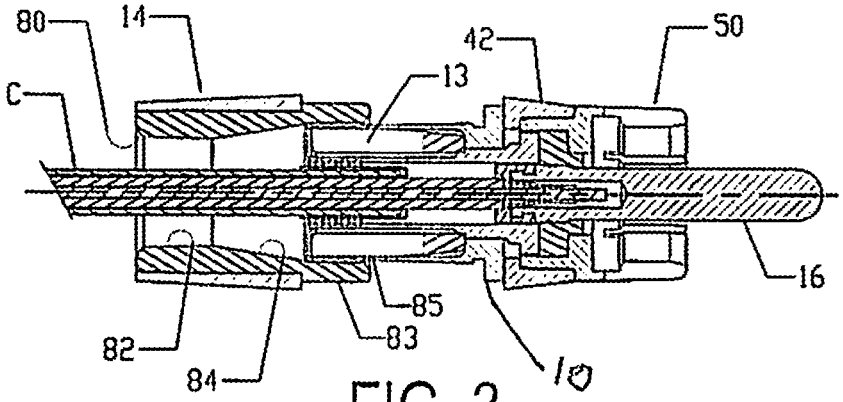
FIG. 3 is another longitudinal sectional view of the one embodiment illustrating advancement of the extension tip and cable through the connector assembly prior to the crimping operation.

The opposite end of the body 10 is made up of a ferrule 50 which is slotted as at 52 into spring-like annular segments 54 extending from an annular base portion 56 of the ferrule 50 to facilitate attachment to a post or terminal, not shown, and the base 56 forms a central opening or passage for advancement of the tip 16 beyond the end of the ferrule, as shown in FIG. 3. The base 56 has a rearward extension or keeper 60 of annular configuration between the band 42 and the guide 33 as well as the flange 39 on the inner sleeve. Thus, the inner walls of the sleeve 11 and guide 33 define the inner wall surface of the body 10, and the guide 33 is provided with an internal shoulder 63 to limit advancement of the extension tip 16 through the body 10.

Figure 2:
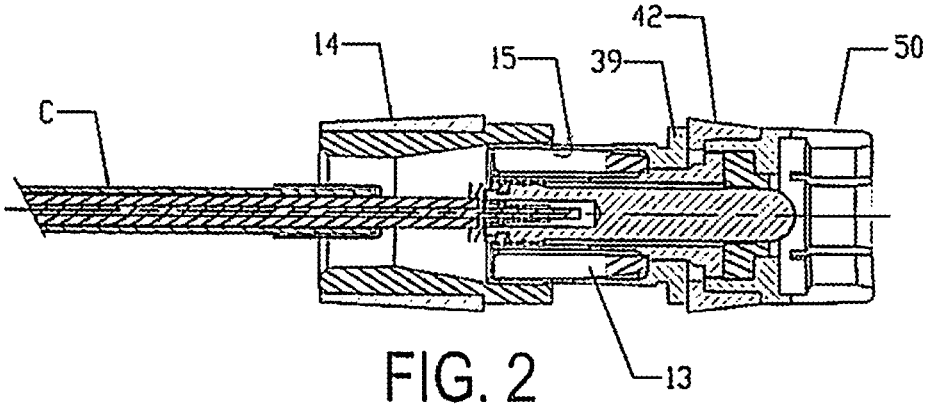
FIG. 2 is a longitudinal sectional view of the one embodiment of FIG. 1 with the mini-coaxial cable inserted into the modified extension tip prior to a crimping operation.

The modified extension tip 16' and cable Care illustrated in exploded form in FIG. 1, the tip 16' being shown inserted into the connector body 10 and comprises an elongated cylindrical metal body 66' terminating in a recessed end 68' for press-fit engagement with a supplementary plastic extension rod 69; and an elongated central bore or recess 70' extends through the opposite end for a limited length of the tip 16'. The extension rod 69 is of a diameter corresponding to the tip 16' with a projecting end 71 of reduced diameter for press-fit engagement with the recessed end 68'. When the extension rod is inserted into the connector body and advanced through the centering guide 33 as shown in FIGS. 1-3, the extension tip 16' will project to a position close to or flush with the end of the crimping ring assembly 14. An annular insulator cap 72' is mounted on the opposite end of the tip 16' in surrounding relation to the entrance to the bore 70 and supports the end of an elongated spring 74' extending through the bore and offset from the wall slightly to bear against the conductor pin 20. The end of the cap 72' is beveled as at 73' to wedge against the dielectric layer 22 surrounding the pin 20 and which is peeled away from the pin 20 into the outer layer 24' as earlier described.

Figure 4:
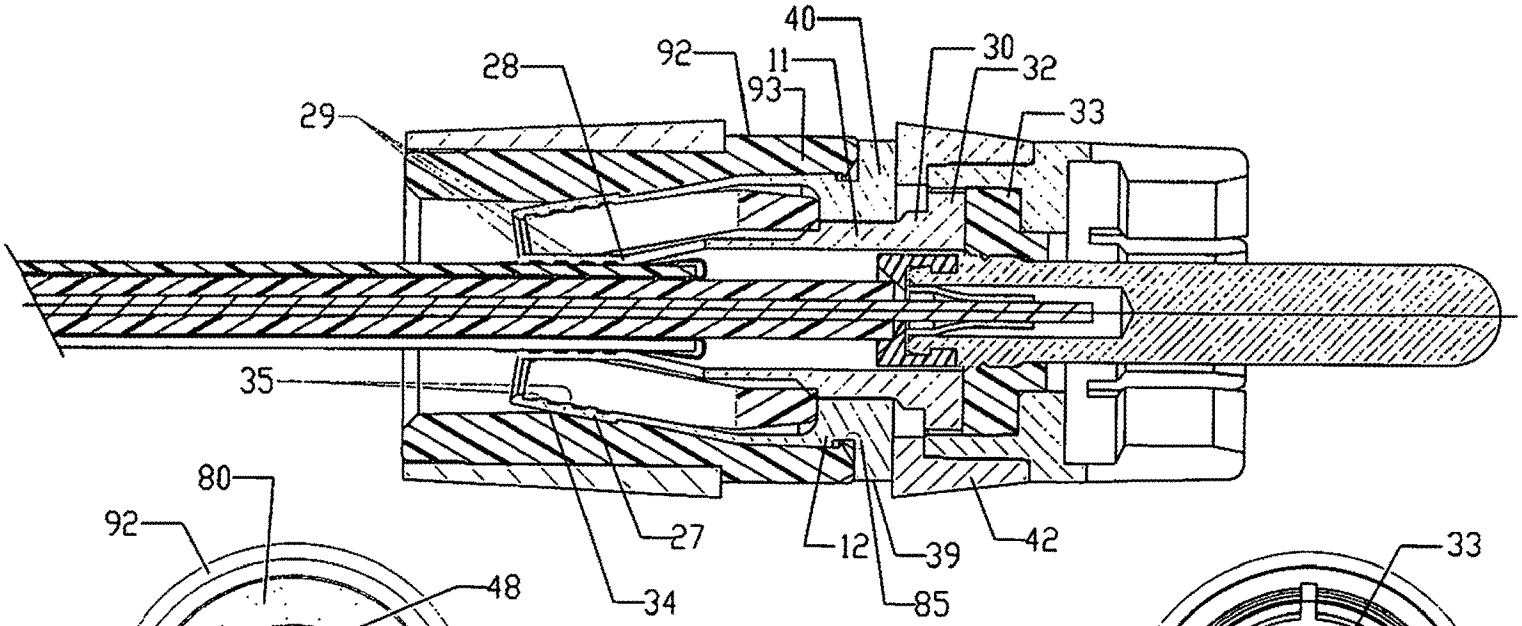
FIG. 4 is an enlarged longitudinal sectional view of the one embodiment following the crimping operation.
Figure 6:
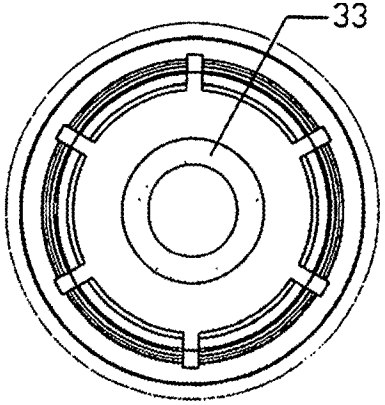
FIG. 6 is an end view of the opposite end of the one embodiment to that shown in FIG. 5.
Figure 5:
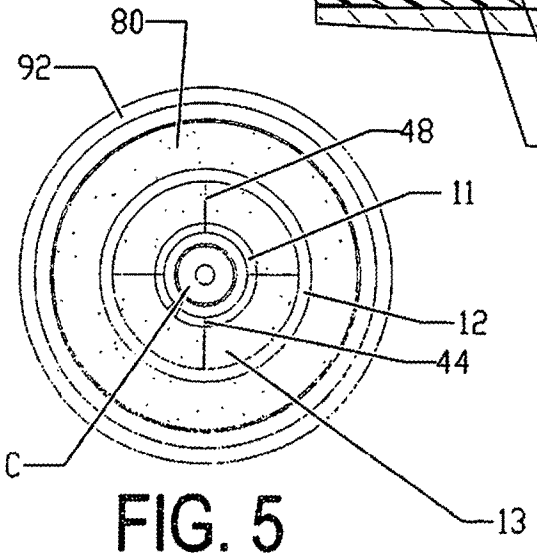
FIG. 5 is an end view of the one embodiment illustrated from the entrance end of the cable.
Figure 7:
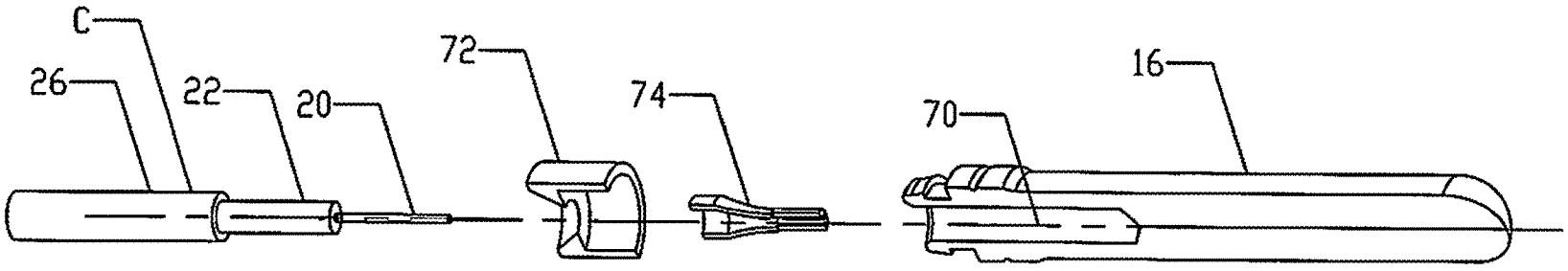
FIG. 7 is an exploded view of the parts comprising the coaxial cable and modified extension tip prior to assembly.

The crimping ring assembly 14 is of a type that can be preassembled onto the connector body 10 and axially advanced over the sleeve 12 to force it into crimping engagement with the slotted end 44 of the compression ring 13. To this end, the crimping ring 14 is made up of an annular body 80 composed of a low-friction material having limited compressibility, such as, DELRIN®, or other hardened plastic material. The body has a straight cylindrical portion 82 and a forwardly tapered portion 84 which terminates in a leading end 83 having an internal shoulder or rib 85. The leading end 83 fits over the trailing end of the sleeve 12 so that the crimping ring 14 can be axially advanced over the end of the sleeve 12 until the internal shoulder or rib 85 advances past the raised end 34, as shown in FIG. 4, to preassemble the ring 14 onto the connector 10.

An exterior surface of the body 80 is recessed or undercut to receive a reinforcing liner 92 which is preferably composed of brass and which fits snugly over the body 80. The leading end 93 of the liner 92 projects outwardly beyond the external surface of the body 80 to define an external shoulder of a diameter slightly greater than that of the leading end 83, as best seen from FIG. 4.

The extension tip 16' is inserted into the connector body 10 until the end of the extension rod 69 opposite to the reduced end 79 is positioned in alignment with the centering guide 33, as shown in FIG. 1, so that the entrance to the bore 70' is at or in close proximity to the entrance to the crimping ring assembly 14 to thereby facilitate insertion of the conductor pin 20 into the beveled end 73' of the bore 70'. The crimping ring assembly 14 is preassembled onto the sleeve 12, as described earlier. Typically, the extension tip 16' and crimping ring 14 are preassembled in the manner just described prior to shipment to the field so that the color coding of the elements is followed to signify the desired cable size and application of the connector assembly to the installer. Although not illustrated in FIGS. 2 and 3, when the cable is advanced to the intermediate position shown in FIG. 2, the extension rod 69 can be removed or permitted to drop off the end of the extension tip 16'. A standard crimping tool, not shown, may be employed to axially advance the crimping ring 14 over the sleeve 12 until the leading end or rib 85 moves into snap-fit engagement with the groove 41 and abuts the shoulder 40. The tapered surface 84 will cause the end portion 34 of the sleeve 12 to radially contract and force the compression ring 13 into positive engagement with the inner sleeve 11 and in turn cause the rings 29 on the segments to be crimped into positive engagement with the jacket 26 as well as the doubled-over portion 24'. One such crimping tool is disclosed in U.S. Pat. No. 6,089,913 and is incorporated by reference herein. The cooperation between the ribs 34 when forced into the compression ring 13 and in turn forcing the internal teeth 29 into engagement with the layer 24' as well as the jacket 26 increases the pull-out strength of the termination assembly both with respect to the end of the cable C and the connector 10.

Detailed Description of a Second Embodiment with Crimping Ring Assembly

Figure 9:
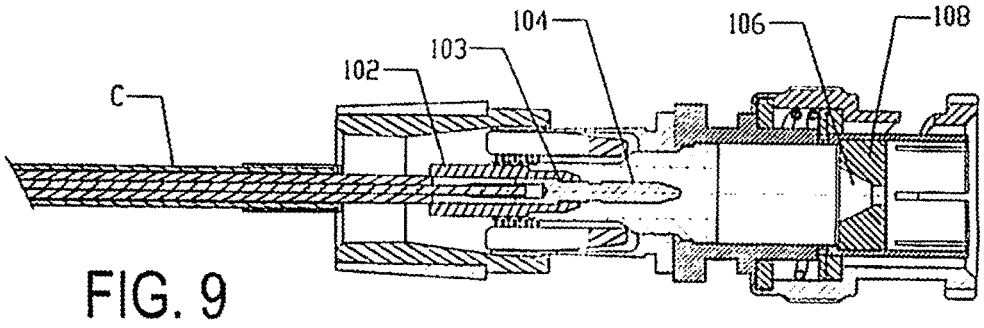
FIG. 9 is a longitudinal sectional view of a second embodiment illustrating a BNC connector assembly and illustrating a mini-coaxial cable inserted into the pre-assembled modified extension tip.
Figure 10:
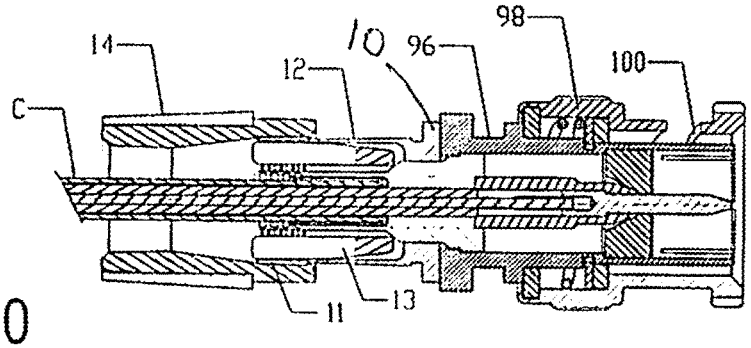
FIG. 10 is another longitudinal sectional view of the embodiment shown in FIG. 9 after advancement of the cable and extension tip through the connector assembly but prior to the crimping operation.
Figure 11:
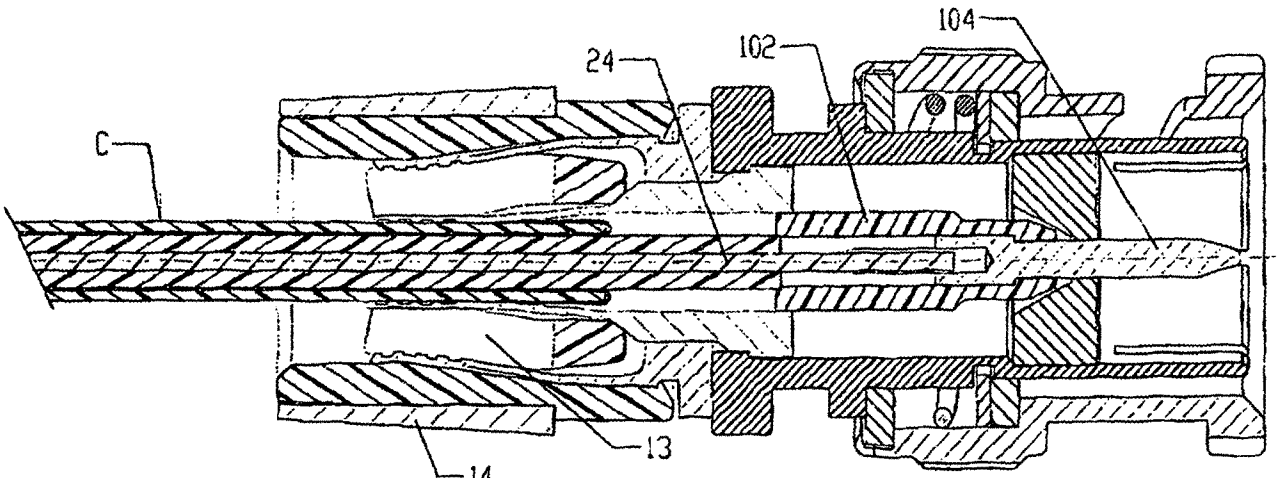
FIG. 11 is an enlarged longitudinal sectional view of the second embodiment shown in FIGS. 9 and 10 following the crimping operation.
Figure 13:
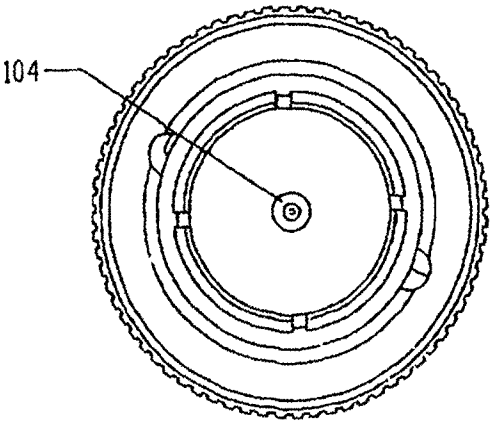
FIG. 13 is an end view taken from the opposite end of FIG. 11 to that of FIG. 12
Figure 12:
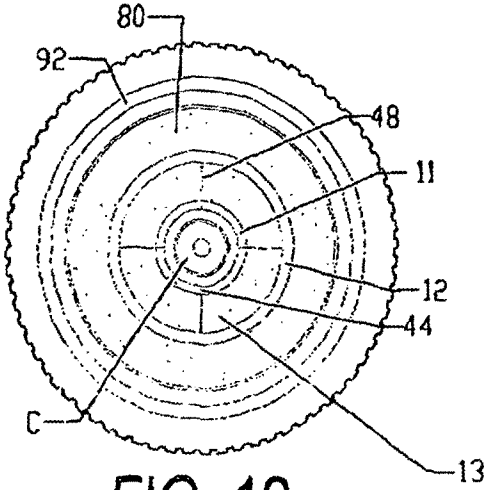
FIG. 12 is an end view taken from the entrance end of the cable in FIG. 11.

FIGS. 9 to 13 illustrate a modified form of connector assembly 10' for a BNC connector or fitting of increased length compared to the RCA connector shown in FIGS. 1 to 8 and having an elongated barrel 96 with a bayonet slot 98 connected to a ferrule 100 Inner and outer spaced connector sleeves 11 and 12 and compression ring 13 along with the crimping ring assembly correspond to those of FIGS. 1 to 8 and are correspondingly enumerated along with the cable C. Owing to the increased length of the fitting, the extension tip 16 is replaced by an insert socket 102 having a hollow nose 103 of reduced diameter which is slidably disposed within the inner sleeve 11, and an extension pin 104 is disposed on the exposed end of the conductor pin 22 of the cable C. Initially, as shown in FIG. 9, the pin 104 will guide the cable C into engagement with the socket 102. Continued advancement of the cable C will cause the pin 104 to carry the socket 102 into alignment with a beveled opening 106 in a stationary block 108 at the end of the ferrule 100 and until the pin 104 reaches the end of the ferrule 100, as shown in FIG. 10. In a manner corresponding to FIGS. 1 to 8, forward advancement of the crimping ring assembly 14 will crimp the inner sleeve 11 into positive engagement with the cable jacket 26, as illustrated in FIGS. 11 to 13; and as best illustrated in the end view of FIG. 12, the compression ring 13 can be dyed a specific color representing the size of cable C which will best fit and provide optimum crimping engagement with the connector body 10.

Detailed Description of First and Second Embodiments with Compression Tool

Figure 17:
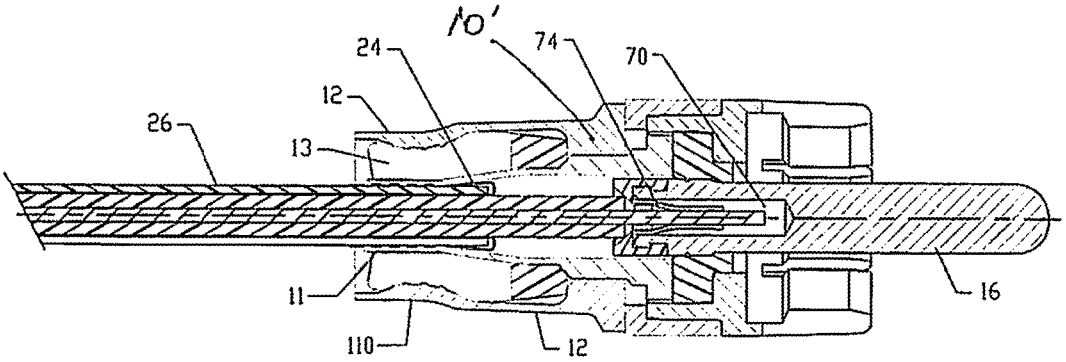
FIG. 17 is a longitudinal sectional view of the embodiment shown in FIGS. 14 and 15 after the crimping operation.

FIG. 14 illustrates a compression tool Tin place of a crimping ring assembly 14 previously described for crimping an RCA connector similar to that of FIGS. 1 to 8 and in which like parts of the cable C and connector body 10 are correspondingly enumerated. The principal modification is the utilization of an outer sleeve 12' having a convex raised surface portion 110. The cable C is inserted into the tip extender 16 so as to be anchored in chuck 112 and centered in relation to the dies 114, 115 as the dies 114, 115 are advanced into crimping engagement with the outer sleeve 12'. Again, and as shown in FIGS. 15 and 16, the connector body 10' includes an annular plastic insert 13' in the space between the inner and outer concentric sleeves 11' and 12' for the mini-coaxial cable represented at C, and the outer jacket 26 and braided insulator 24 are positively engaged by the inner sleeve 11' when the outer sleeve 12' and ring 13' are compressed radially inwardly by the compression tool T, as shown in FIG. 17.

Figure 18:
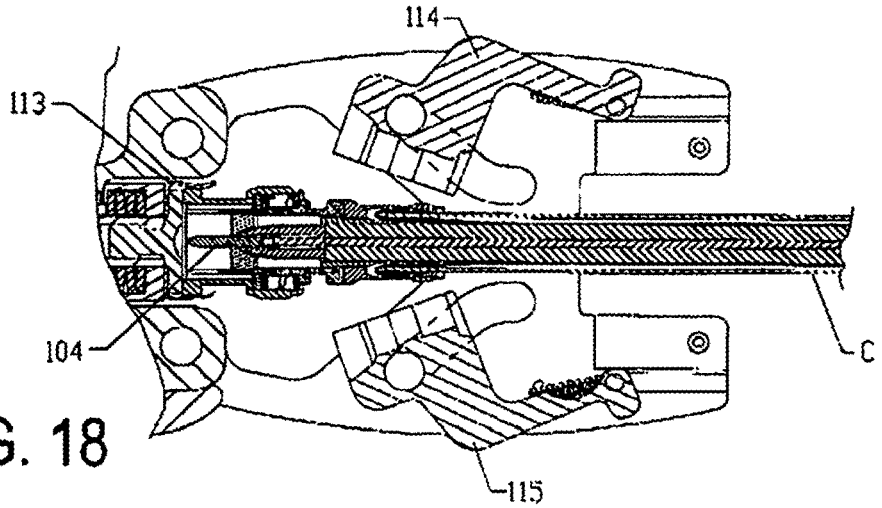
FIG. 18 is a longitudinal sectional view of still another embodiment with the parts assembled prior to advancement through the connector assembly.
Figure 19:
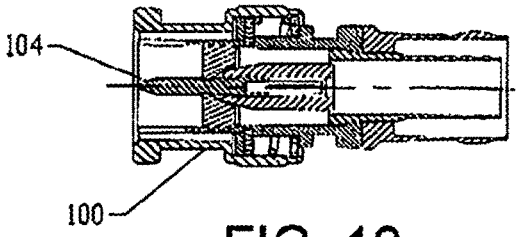
FIG. 19 is another sectional view corresponding to that of FIG. 18 with the coaxial cable and extension tip fully inserted into the connector assembly.
Figure 20:
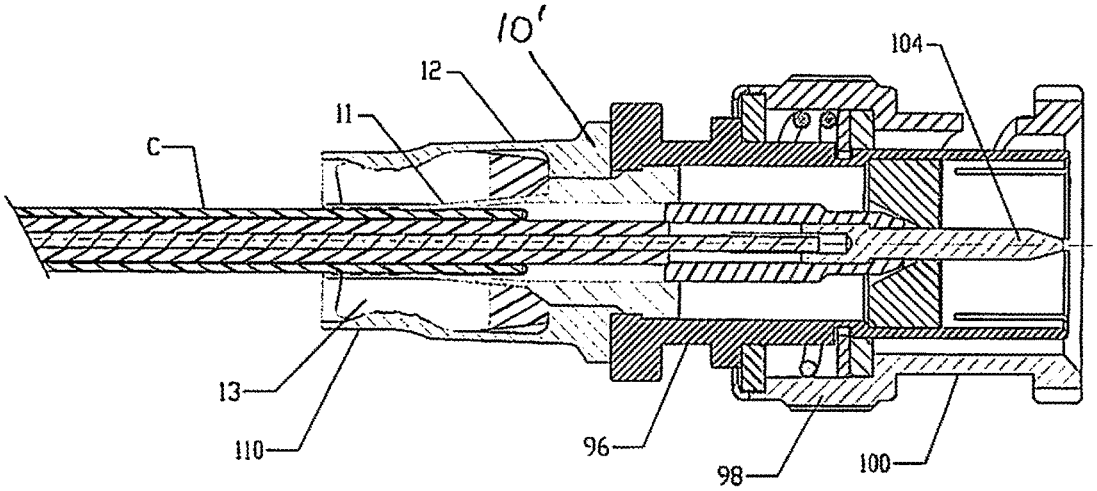
FIG. 20 is a longitudinal sectional view of the embodiment shown in FIGS. 18 and 19 following the crimping operation.

FIGS. 18 to 20 illustrate the manner in which the BNC connector of FIGS. 9 to 13 can be crimped by the compression tool T and specifically wherein the ferrule 100 is inserted between the spring clips 113 prior to compression of the sleeves 11 ', 12' and the compression ring 13' by the compression die members 114 and 115.

Mini-coaxial cables are particularly useful in cellular telephones, security cameras and other applications where there are decided space limitations or where short runs of cable are used. Referring to the embodiments shown and described, it will be evident that the thickness of the compression ring 13, as well as the width of the slots 44 and 48 may be varied according to the size or diameter of the cable C and be proportioned according to the space allowance between the cable C and the connector sleeve 11. Further, the compression ring may be installed either before or after shipment to the field. For example, it may be desirable for the installer to select a particular size of compression ring which would be dyed or colored to match a particular cable size. To that end, the compression ring 13 should have sufficient elasticity or spreadability to be inserted axially into the annular space between the assembled sleeves 11 and 12.

The resilient band 42 shown in FIG. 2, may be inserted into the groove formed between the ferrule 50 and the shoulder 40 after the connector has been crimped together into the closed position. The band 42 is manually stretchable over the end of the ferrule 50 and, when released, will contract into the groove as described. The band 42 also may be one of several different colors to signify the intended application of the connector to a particular use. In addition, the compression ring 13 as well as the guides 33 and 72 may be of different selected colors which represent the size of cable C for which the connector body 14 is designed. The cap is visible to the installer when inserting the cable C into the tip 16 prior to the crimping operation, and both the guide 33 and ring 13 are visible from either end of the connector body 10, as shown in FIGS. 5, 6 and 12, 13 after the crimping operation.

Detailed Description of Additional Embodiment

Figure 21:
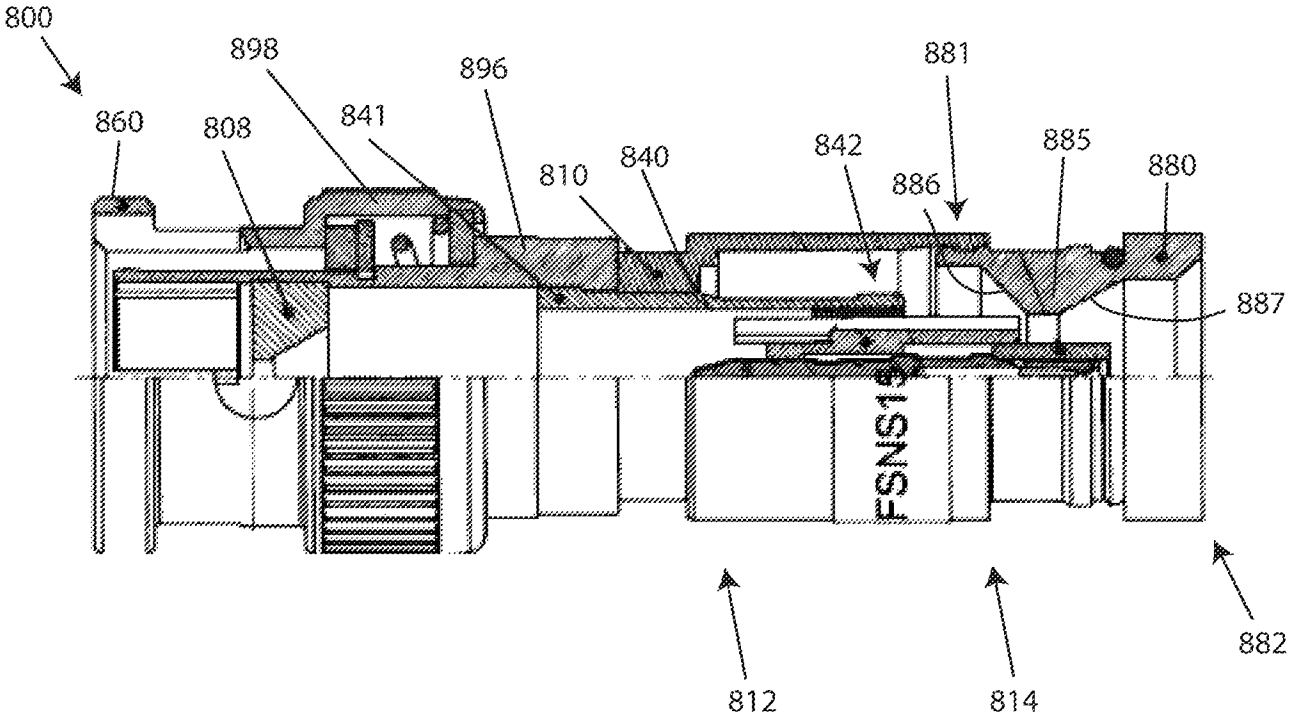
FIG. 21 depicts a partial cut-away view of an additional embodiment of a coaxial cable connector.

FIG. 21 depicts an embodiment of connector 800, which illustrates an additional embodiment of connector assembly 10' for a BNC connector or fitting of increased length compared to the RCA connector shown in FIGS. 1 to 8. Embodiments of connector 800 may share the same structural components and functional aspects as the connector as shown in FIGS. 9-13 and described supra. For instance, embodiments of connector 800 may include an elongated barrel 896 with a bayonet slot 898 connected to a ferrule 860, an inner sleeve 840, and a connector body 810.

Embodiments of the inner sleeve 840 may include the same structural and/or functional aspects as inner sleeve 11 described above. Embodiments of the inner sleeve 840 may include a first end 841 and a second end 842. The second end 842 of the inner sleeve 840 may receive the cable C. When the cable C is inserted, the center conductor may engage a moveable pin assembly configured to be driven through the connector 800 during installation and attachment of the connector 800 to the cable C. The prepared cable C is inserted into the tip 16' and advanced through the body 10 until the slotted segments of the inner sleeve are positioned over the doubled-over layer 24' and jacket 26. Moreover, the second end 842 may be slotted so as to facilitate compression of the second end of the inner sleeve 840. In other words, the second of the inner sleeve 840 may be provided with circumferentially spaced longitudinal slots, the slots each being of a width to control the inward degree of bending by a compression portion 885 of the compression sleeve 880.

Embodiments of the connector body 810 may have a first end 812 and a second end 814. The second end 814 of the connector body 810 may include a retention feature, such as a lip, annular detent, edge, and the like, for structurally retaining a compression sleeve 880 in a preassembled position. In the preassembled position, the connector sleeve 880 is not axially advanced to a compressed position. In other embodiments, the connector body 810 may include more than one retention feature proximate, at, or otherwise near the second end 814. The retention feature of the connector body 810 may structurally correspond to a structural feature on the compression sleeve 880. The structural cooperation between the retention feature of the connector body 810 and the structural feature on the compression sleeve 880 may act to retain the two components together in a preassembled position. Embodiments of the structural feature of the compression sleeve 880 may be located at, proximate, or otherwise near the first end 881 of the compression sleeve 880. There may be more than one structural engagement feature of the compression sleeve to cooperate with the retention feature of the connector body 810.

Furthermore, embodiments of the compression sleeve 880 may include a first end 881, a second end 882, a compression portion 885 having a forward facing surface 886 and a rearward facing surface 887. Embodiments of the compression sleeve 880 may be operably connected to the connector body 810 in a preassembled position, or may be attached in the field. Embodiments of the compression sleeve 880 may be a compression member, a fastener member, and the like, configured to functionally engage a connector body 810 and create a seal against the cable C when axially compressed toward the front end of the connector 800. Embodiments of the compression portion 885 may be structurally integral with the compression sleeve 880; however, a separate component sharing its structural design may be attached to an inner surface of the compression sleeve 880. Embodiments of the compression portion 885 may protrude from an inner surface of the compression sleeve 880 a significant distance to ensure engagement with the second end 842 of the inner sleeve 840. The forward facing surface 886 and the rearward facing surface 887 may be tapered or ramped to allow or assist the compression sleeve 880 to move axially forward within the connector body 810, while exerting a gradually increasing compressive force against the slotted end 842 of the inner sleeve 840 until a fully compressed position is achieved. The radially inward compression of the second end 842 of the inner sleeve 840 may result in radial compression of the prepared end of the cable C. For instance, the second end 842 of the inner sleeve 840 may be compressed into sealing or sufficient mechanical interference with the doubled-over braided layer (i.e. outer conductor) of the cable C. Thus, a fastener member, such as compression member 880 may directly apply a compressive force against the inner sleeve 840 to grip, secure, and/or seal the outer conductor of the cable C when the cable C is installed within the connector 800. The direct compressive force against the second end 842 of the inner sleeve 840 onto the cable C requires less compression than having to compressive an outer connector body, a sleeve insert, and an inner sleeve onto the cable.

It is therefore to be understood that while different embodiments are herein set forth and described, the above and other modifications may be made therein without departing from the spirit and scope of the invention as defined by the appended claims and reasonable equivalents thereof.

The invention claimed is:

1. A connector comprising:

a conductive connector body having a main bore defining an aperture at an aft end;

a tip assembly having an outer rod centered within the main bore, a conductive inner tip extending axially relative to the outer rod, and a centering member disposed in the main bore between the aft and a forward end, the centering member having a conical surface configured to receive the conductive inner tip;

wherein a coaxial cable is received in the aperture of the conductive connector body and an inner conductor thereof effects translation of the conductive inner tip for engaging a signal transmitting interface port.

2. The connector of claim 1, further comprising:

a compression member slideably engaging the conductive connector body;

a conductive sleeve disposed in the main bore and connected to the connector body, the conductive sleeve having a plurality of compression segments extending axially toward the aperture of the connector body;

wherein the compression member is axially displaced to effect radial displacement of the compression segments into crimping engagement with an outer conductor of the coaxial cable.

3. The connector of claim 1, wherein the conductive connector body defines a plurality of axially extending segments at a forward end, the axially extending segments configured to frictionally engage a peripheral surface of an interface port.

4. The connector of claim 1, wherein the conductive inner tip includes a socket configured to accept a center conductor of different sizes.

5. The connector of claim 1, wherein the conductive sleeve comprises an annular ring affixed to an inner surface of the connector body and each of the axially extending segments are integrally formed with the annular ring.

6. The connector of claim 1, wherein each of the axially extending segments flex about a hinge axis which facilitates different size coaxial cables.

7. The connector of claim 1, further comprising a conically-shaped centering member for supporting the tip assembly.

8. The connector of claim 2, wherein the conductive sleeve includes an inwardly projecting surface configured to radially displace the compression segments.

9. The connector of claim 8, wherein the inwardly projecting surface includes a ramped surface configured to gradually compress the compression segments into crimping engagement with an outer conductor of the coaxial cable.

10. The connector of claim 8, wherein the inwardly projecting surface is tapered.

11. The connector of claim 1, wherein the coaxial cable is a mini-coaxial cable.

12. A connector comprising:

a conductive connector body defining a main bore having an aperture for receiving a coaxial cable at a first end;

a compression member slideably engaging the conductive connector body; and a conductive sleeve disposed in the main bore and mounted to the conductive connector body, the conductive sleeve having a plurality of circumferentially-spaced slots defining a plurality of axially extending compression segments directed toward the first end;

wherein, subsequent to receiving the coaxial cable at the first end, the compression member urges the compression segments into crimping engagement with the outer conductor of the coaxial cable.

13. The connector of claim 12, wherein the conductive connector body defines a plurality of axially extending segments at a second end thereof, the axially extending segments being configured to frictionally mate with and engage a peripheral surface of an interface port.

14. The connector of claim 13, further comprising a tip assembly having an outer rod centered within the main bore, the outer rod having a central bore for telescopically receiving a conductive inner tip, a centering member disposed in the main bore of the connector body and having an orifice for receiving the conductive inner tip, and wherein an inner conductor of a coaxial cable effects telescopic translation of the conductive inner tip for engaging a signal transmitting interface port.

15. The connector of claim 14 wherein the centering member includes a conical surface configured to direct the inner conductor into the orifice.

16. The coaxial cable connector of claim 12 wherein the sleeve includes an inwardly projecting surface configured to radially displace the compression segments.

17. The coaxial cable connector of claim 16, wherein the inwardly projecting surface includes a ramped surface configured to gradually compress the compression segments into crimping engagement with the outer conductor of the coaxial cable.

18. The coaxial cable connector of claim 17 wherein the inwardly projecting surface is tapered.

19. The coaxial cable connector of claim 12 wherein a diameter dimension of the coaxial cable varies.

20. A connector comprising:

a conductive connector body having a first end, a second end, and a main bore defining an aperture for receiving a coaxial cable at the first end, the connector body having a plurality of axially extending segments at the second end;

a centering member disposed in the main bore between the first and second ends and having an orifice;

a compression member slideably engaging the connector body;

a conductive sleeve disposed in the main bore and mounted to the conductive connector body, the conductive sleeve having a plurality of circumferentially-spaced slots defining a plurality of axially extending compression segments; and a tip assembly configured to receive an inner conductor of the coaxial cable and having an inner conductor supported by the centering member;

wherein the inner conductor is displaced by axial motion of the coaxial cable through the orifice and into engagement with the signal-transmitting interface;

wherein, subsequent to receiving the coaxial cable at the first end, the compression member urges the compression segments into crimping engagement with the outer conductor of the coaxial cable, and wherein the plurality of axially extending segments are configured to frictionally mate with and engage a peripheral surface of a signal-transmitting interface port.

21. The connector of claim 20, wherein the inner conductor includes a socket configured to accept a center conductor of different sizes.

22. The connector of claim 20, wherein the conductive sleeve comprises an annular ring affixed to an inner surface of the conductive connector body and the axially extending segments are integrally formed with the annular ring.

23. The connector of claim 18, wherein each of the axially extending segments flex about a hinge axis which facilitates different size coaxial cables.

24. The connector of claim 20, wherein the conductive sleeve includes an inwardly projecting surface having a ramped surface configured to gradually compress the compression segments into crimping engagement with the outer conductor of the coaxial cable.

25. The connector of claim 24, wherein the inwardly projecting surface is tapered.

26. The connector of claim 20, wherein a diameter dimension of the coaxial cable varies.

* * * * *